US007428947B2

(12) United States Patent
Nohl et al.

(10) Patent No.: US 7,428,947 B2
(45) Date of Patent: Sep. 30, 2008

(54) ELECTRICALLY CONTROLLED IN-MUFFLER EXHAUST VALVE FOR USE DURING CYLINDER DEACTIVATION

(75) Inventors: John P. Nohl, Indianapolis, IN (US); David R. Woemer, Nashville, IN (US); Joseph E. Callahan, Greenwood, IN (US)

(73) Assignee: EMCON Technologies LLC, Wilmington, DE (US)

( * ) Notice: Subject to any disclaimer, the term of this patent is extended or adjusted under 35 U.S.C. 154(b) by 596 days.

(21) Appl. No.: 10/777,394

(22) Filed: Feb. 12, 2004

(65) Prior Publication Data

US 2005/0178612 A1 Aug. 18, 2005

(51) Int. Cl.
*F01N 1/08* (2006.01)
*F01N 1/16* (2006.01)

(52) U.S. Cl. ..... 181/254; 181/237; 181/241; 181/277; 181/253

(58) Field of Classification Search ..... 181/254, 181/237, 241, 253, 277, 278
See application file for complete search history.

(56) References Cited

U.S. PATENT DOCUMENTS

| | | | | |
|---|---|---|---|---|
| 4,866,933 | A * | 9/1989 | Kao | 60/312 |
| 4,926,636 | A * | 5/1990 | Tadokoro et al. | 60/312 |
| 5,290,974 | A * | 3/1994 | Douglas et al. | 181/228 |
| 5,388,408 | A * | 2/1995 | Lawrence | 60/324 |
| 5,582,004 | A * | 12/1996 | Rutschmann | 60/288 |
| 5,655,367 | A * | 8/1997 | Peube et al. | 60/324 |
| 5,739,483 | A * | 4/1998 | Yashiro et al. | 181/254 |
| 6,178,745 | B1 * | 1/2001 | Meusen | 60/312 |
| 6,662,554 | B2 * | 12/2003 | Sheidler et al. | 60/290 |

FOREIGN PATENT DOCUMENTS

| | | | |
|---|---|---|---|
| EP | 1036919 | A2 | 2/2000 |
| JP | 61112713 | | 5/1986 |
| JP | 09079023 | | 3/1997 |
| JP | 2003161149 | | 6/2003 |
| JP | 2003161149 | A * | 6/2003 |

OTHER PUBLICATIONS

Search Report EP 05 25 0283.
Kolbenschmidt Pierburg Exhaust Flap Design.

* cited by examiner

*Primary Examiner*—Lincoln Donovan
*Assistant Examiner*—Jeremy Luks
(74) *Attorney, Agent, or Firm*—Carlson, Gaskey & Olds

(57) ABSTRACT

A powertrain control system is provided that includes an engine having multiple cylinders. A controller selectively activates the cylinders to provide a cylinder combination having a desired power displacement. In one example powertrain control system, the controller selectively activates the cylinders between a V-8 and V-4 mode. An exhaust system having a valve and an electrical actuator selectively electrically actuates the valve in response to the controller between multiple positions. The electrical actuator moves the valve from an open position in V-8 mode to a partially closed position in V-4 mode to increase back pressure and reduce NVH issues in V-4 mode. A muffler includes a housing having an exhaust passage. The valve is supported by the housing and arranged in the exhaust passage. The valve is moveable between multiple positions for tuning the muffler. The electrical actuator is supported by the housing to actuate the valve between the multiple positions.

17 Claims, 2 Drawing Sheets

ELECTRICALLY CONTROLLED IN-MUFFLER EXHAUST VALVE FOR USE DURING CYLINDER DEACTIVATION

BACKGROUND OF THE INVENTION

This invention relates to an exhaust system having a valve for reducing noise, vibration and harshness (NVH). In particular, the invention relates to an electrically controlled in-muffler exhaust valve for displacement on demand internal combustion engines.

Automobile manufacturers are continuing to develop vehicles having greater fuel economy. In particular, larger vehicles having larger displacement engines have been targeted for better fuel economy. One solution to provide a more fuel efficient vehicle is so-called displacement on demand engines that have cylinder selectively activated depending upon operating conditions. For example, a V-8 operates in V-8 mode when the vehicle requires more power such as towing a trailer. The powertrain control system deactivates four of the cylinders so that the engine operates in V-4 mode when the vehicle requires less power such as when it is lightly loaded and cruising at highway speeds.

One challenge of commercializing displacement on demand engine configurations is that the change between engine modes must be transparent to the vehicle operator. Typically the exhaust system, and in particular the muffler, are tuned so that NVH are minimized when in V-8 mode. However, when the cylinders are deactivated to change from V-8 to V-4 mode the exhaust system produces a tinny or hollow sound considered undesirable to the vehicle operator. To reduce NVH issues when changing from V-8 mode to V-4 mode, an exhaust valve has been used upstream of the muffler behind the catalytic converter. The exhaust valve blocks exhaust flow to increase back pressure and reflects sound wave energy to reduce the low frequency noise levels experienced in V-4 mode.

One prior solution utilizes a cast iron housing arranged between the muffler and catalytic converter. A valve arranged in the cast iron housing is actuated by a vacuum actuator. Vacuum hoses must be routed a considerable length from the engine to the exhaust system to operate the vacuum actuator. The cast housing has considerable weight and presents reliability issues and increased assembly attributable to the connections between the cast housing and the adjacent exhaust system components. Furthermore, the vacuum actuator presents reliability issues resulting from the considerable length the vacuum hoses and connections, which may be damaged during off road vehicle use or assembly at the vehicle assembly plant. Moreover, since the actuator is vacuum operated, limited control over the valve is possible since its operation is based upon engine manifold pressure. Furthermore, the vacuum actuator lacks safeguards in the event of an actuator or valve malfunction.

Therefore, what is needed is an improved powertrain system providing variable tuning in, for example, displacement on demand engine configurations.

SUMMARY OF THE INVENTION AND ADVANTAGES

The invention provides a powertrain control system including an engine having multiple cylinders. A controller selectively activates the cylinders to provide a cylinder combination having a desired power displacement. In one example powertrain control system, the controller selectively activates the cylinders between a V-8 and V-4 mode. An exhaust system having a valve and an electrical actuator selectively electrically actuates the valve in response to the controller between multiple positions. In an example of the invention, the electrical actuator moves the valve from an open position in V-8 mode to a partially closed position in V-4 mode to increase back pressure and reduce NVH issues in V-4 mode.

In an example exhaust system, a muffler includes a housing having an exhaust passage. The valve is supported by the housing and arranged in the exhaust passage. The valve is moveable between multiple positions for tuning the muffler. The electrical actuator is supported by the housing to actuate the valve between the multiple positions. The actuator is supported by an actuator mounting pipe arranged exterior of the main housing portion to remove it from the high temperatures found within the main housing portion. The actuator is further insulated by using one or more heat shields between the actuator and portions of the housing. A return spring moves the valve to an open position in the event of a system malfunction. A position sensor detects the position of the valve to ensure that the valve is operating as desired and to coordinate the valve operation with other aspects of the powertrain control system.

Accordingly, the present invention provides an improved powertrain system providing variable tuning in displacement on demand engine configurations.

BRIEF DESCRIPTION OF THE DRAWINGS

Other advantages of the present invention can be understood by reference to the following detailed description when considered in connection with the accompanying drawings wherein.

DETAILED DESCRIPTION OF THE PREFERRED EMBODIMENT

Figure 1:
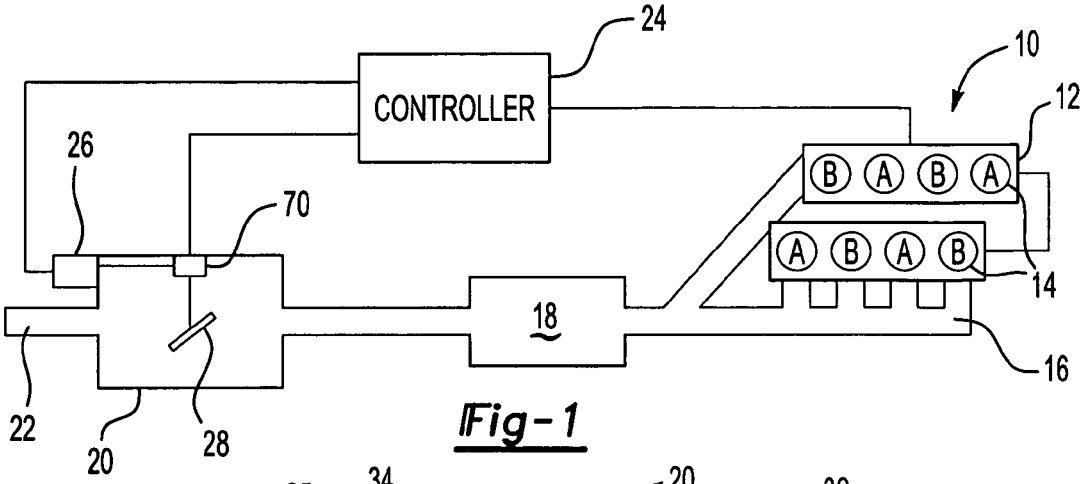
FIG. 1 is a schematic view of the inventive powertrain control system.

A powertrain control system 10 is shown in FIG. 1. The system 10 includes an internal combustion engine 12 having multiple cylinders 14. In the example shown, there are eight cylinders having two groups, A and B. In a V-8 mode both cylinders A and B are activated, for example by supply fuel to all cylinders, so that all eight cylinders provide power to the vehicle. In a V-4 mode only cylinders A are activated so that only four cylinders provide power to the vehicle, for example by cutting fuel to cylinders B, thereby reducing fuel consumption and increasing fuel economy during vehicle operating conditions in which reduced engine power is not noticeable to the vehicle operator. It should be understood, however, that although the invention has been discussed with reference to V-8 and V-4 modes, other engine configurations having other displacement configurations and modes may also be used with this invention.

The system 10 includes an exhaust system 17 receiving exhaust gases from the cylinders 14. The exhaust system 17 includes exhaust manifolds 16 that carry the exhaust gases to a catalytic converter 18. The exhaust gases flow from the catalytic converter to a muffler 20 tuned to reduce NVH issues, and the exhaust gases are expelled from a tailpipe 22.

The muffler 20 includes internal structure that provides tuning to reduce the NVH issues for the engine 12. However, since the engine 12 has multiple operating modes, the structural features of the muffler 20 can only be tuned for one of the modes. Typically, the muffler 20 is tuned for V-8 mode. As a result, undesirable NVH may result when engine 12 is operating in V-4 mode, which may manifest itself as a tinny or hollow sound. The undesirable NVH issues may be addressed by partially blocking the exhaust flow to increase the back pressure and reflect sound wave energy upstream in the exhaust system 17 to reduce low frequency noise levels in V-4 operation. Secondary mufflers or passive resonators typically found in intake systems are impractical for exhaust systems due to size and packaging considerations. Furthermore, adding additional components and structure exterior to the exhaust system components typically found within a powertrain system is undesirable to due size, weight, and reliability considerations.

The inventive powertrain control system 10 incorporates an electrical actuator 26 that operates a valve 28 moving it between multiple positions. Both the actuator 26 and valve 28 are preferably supported by the muffler 20 using many structural components typical to a muffler. Using an electrical actuator enables the valve 28 to be operated at any time and enables the wires to be routed where they are less likely to become damaged. A controller 24 is connected to the actuator 26 and engine 12 to coordinate the operation of the valve 28 as the engine 12 switches between V-8 and V-4 modes. A position sensor 70 is also supported by the muffler 20 in one example and connected to the controller 24 to detect the position of the valve 28 and ensure desired operation of the actuator 26 and valve 28.

Figure 2:
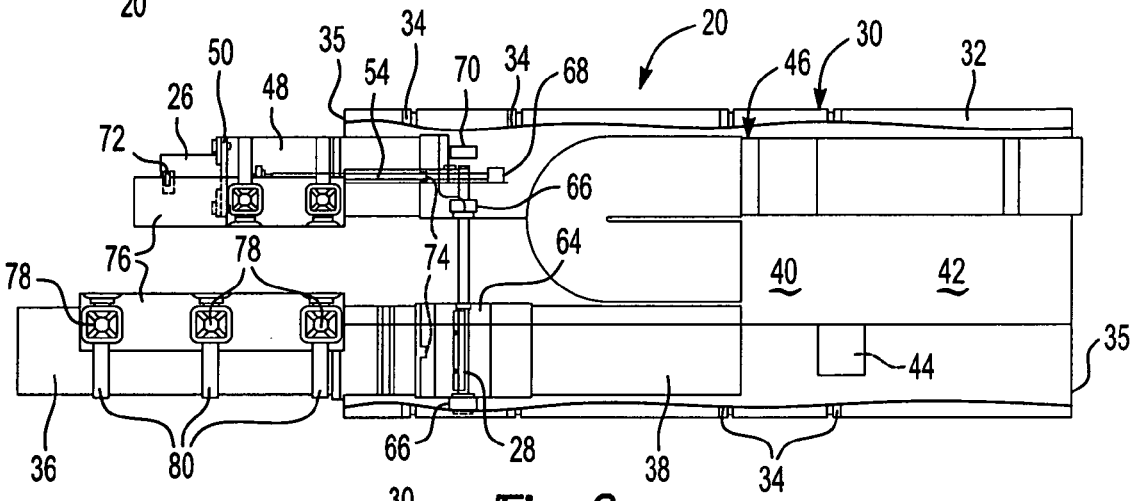
FIG. 2 is a cross-sectional top view of one example of the inventive muffler.

Referring to FIG. 2, the inventive muffler 20 includes a housing 30 having a main housing portion provided an outer shell 32. In the example shown, the main housing portion is the large body where the exhaust is tuned. The main housing portion is approximately the same size as a conventional muffler to avoid packaging issues. Baffles 34 are arranged interiorly of the outer shell 32 to support the outer shell 32 and provide support structure for components within the muffler 20. The baffles 34 also provide resonant chambers and fluid connections between components within the muffler 20, as is well known in the art. End caps 35 are arranged at either end of the muffler to conceal the muffler 20 to enclose the components within.

An inlet pipe 36 is supported by an end cap 35 and carries exhaust gases from the engine 12 to the interior of the muffler 20 for tuning. The exhaust gases from the engine within the inlet pipe 36 are at a considerably high temperature that would melt insulation on the wire windings of an electric actuator.

The exhaust gas flows along an exhaust passageway provided by the inlet pipe 36 and inner pipe 38 arranged within the housing 30. A valve body 64 is arranged between the inlet pipe 36 and inner pipe 38 and provides a portion of the exhaust passage. The valve 28 does not divert exhaust gases to other passages, but rather selectively provides a variable restriction. The exhaust gas flows from the exhaust passage out the inner pipe 38 to a first chamber 40, which is in fluid communication with a second chamber 42 that acts as a Helmholtz resonator. A passage 44 is arranged in a baffle 34 to permit pressure waves to travel between the first 40 and second 42 chambers. Exhaust gas flows from the first chamber to an outlet pipe 46 which may include curves for tuning and packaging within the muffler 20. The inlet pipe 36, inner pipe 38, and outlet pipe 46 are supported by the baffles 34.

Figure 4:
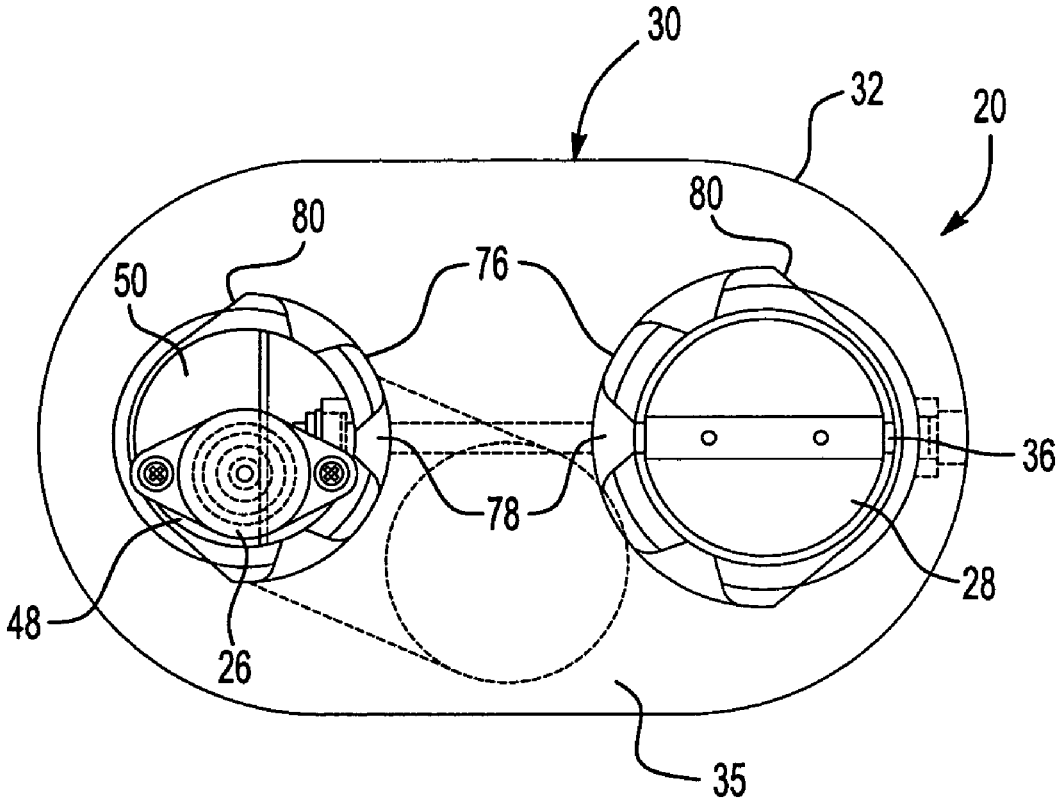
FIG. 4 is an end view of the inventive muffler.

An actuator mounting pipe 48 is supported by an end cap 35 approximate to the inlet pipe 36. The actuator mounting pipe 48 includes a portion that extends exterior of the housing 30 to reduce the temperature to which the actuator mounting pipe is exposed. A plate 50 is supported on the actuator mounting pipe 48 and supports the electrical actuator 26. One or more heat shields 76 are arranged between the electrical actuator 26 and the inlet pipe 36 to reduce the temperature to which the wire windings of the electrical actuator 26 are exposed. For example, one suitable electrical actuator has a temperature limit of approximately 120° C., which makes insulation desirable. A vacuum actuator has a temperature limit of approximately 200° C. The heat shields 76 include protrusions 78, best seen in FIG. 4, used to space the surface of the heat shields 76 from the inlet pipe 36 and actuator mounting pipe 48 to provide improved insulation. The heat shields 76 are secured to the inlet pipe 36 and actuator mounting pipe 48 by band clamps 80.

Figure 3:
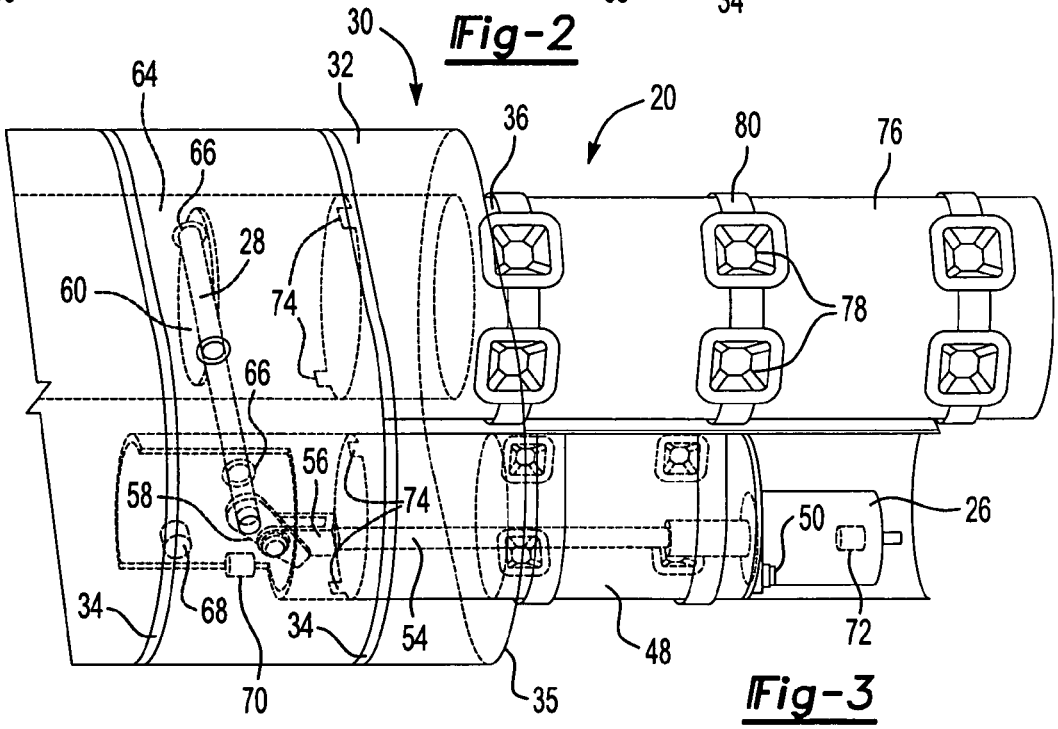
FIG. 3 is a perspective, enlarged cross-sectional view of the inventive actuator and valve arrangement.

Referring to FIGS. 2 and 3, the electrical actuator 26 moves a rod 54 in a generally linear direction. A clevis 56 at an end of the rod 54 is secured to an arm 58 mounted on a shaft 60. The valve 28 is secured to the shaft 60 with the valve 28 arranged within the valve body 64. The shaft 60 is supported by wire mesh bearings 66. One bearing is mounted on the valve body 64 for supporting one end of the shaft 60, and another bearing 66 is mounted on a portion of the actuator mounting pipe 48 that extends into the housing 30. The actuator mounting pipe 48 is sealed off from the hot exhaust gases.

A stop 68 is supported by the actuator mounting pipe 48 to limit the travel of the valve 28. The stop 68, in the example shown, defines the open position used when operating in V-8 mode. A return spring 72 is schematically shown arranged internal to the electrical actuator 26, for a type of actuator well known in the art, to bias the valve 28 to the open position. Specifically, the return spring 72 urges the arm 58 against the stop 68 in the event of an actuator/valve malfunction, for example, in the event the actuator 26 loses power. The baffles 34, actuator mounting pipe 48, and valve body 64 include locating features 74, for example similar to those found in U.S. Pat. No. 5,290,974, for ensuring that the actuator mounting pipe 48 and valve body 64 are oriented in a desired position relative to one another for improved assembly and operation of the muffler 20.

The position sensor 70 is supported by the muffler 20 and, in the example shown, is located within the housing 30 to detect the position of the valve 28. In one example, the position sensor 70 is located proximate to the arm 58 to detect the rotational position of the shaft 60. The position sensor 70 is electrically connected to the controller 24 and the sensor's 70 output is monitored to ensure desired operation of the powertrain control system. For example, if the valve 28 should become stuck or otherwise located in a position other than desired, the controller will command other powertrain controls to ensure the most desirable operation of the powertrain control system.

Mounting the actuator 26 on the outside of the muffler 20 on an actuator mounting pipe 48 that extends away from the body of the muffler 20 reduces the heat to which the actuator 26 is exposed. Employing heat shields 76 near the actuator 26 further reduces the heat exposure of the actuator 26 enabling a lower cost electrical actuator to be supported by the muffler 20 to move the valve 28 within the muffler 20.

The invention has been described in an illustrative manner, and it is to be understood that the terminology that has been used is intended to be in the nature of words of description rather than of limitation. Obviously, many modifications and variations of the present invention are possible in light of the above teachings. It is, therefore, to be understood that within the scope of the appended claims the invention may be practiced otherwise than as specifically described.

What is claimed is:

1. A powertrain control system comprising:

an exhaust muffler including a housing having an exhaust passage;

a valve supported by said housing and arranged in said exhaust passage movable between multiple positions for tuning said exhaust muffler; wherein an exhaust gas flows through said exhaust passage, with substantially all of said exhaust gas flowing through said valve in each of said multiple positions, said valve increasing a back-pressure within said exhaust passage by increasingly blocking said exhaust passage with said valve; and an electrical actuator supported by said housing, said electrical actuator configured to actuate said valve between said multiple positions in response to a desired power displacement signal.

2. The powertrain control system according to claim 1, wherein said housing includes a main housing portion and an actuator mounting pipe extending exteriorly away from said main housing portion, and an inlet pipe extending exteriorly away from said main housing portion proximate and generally parallel to said actuator mounting pipe.

3. The powertrain control system according to claim 2, wherein at least one heat shield is arranged between said electrical actuator and said inlet pipe.

4. The powertrain control system according to claim 1, wherein said exhaust passage includes a valve body supporting said valve with a shaft extending into said valve body and said valve secured to said shaft, said electrical actuator rotating said shaft to move said valve between said multiple positions.

5. The powertrain control system according to claim 4, wherein a rod is arranged transverse to said shaft, and said electrical actuator moving said rod generally linearly to rotate said shaft.

6. The powertrain control system according to claim 5, wherein said housing includes a stop limiting travel of at least one of said rod and said shaft.

7. A powertrain control system comprising:

an exhaust muffler including a housing having an exhaust passage;

a valve supported by said housing and arranged in said exhaust passage movable between multiple positions for tuning said exhaust muffler; wherein an exhaust gas flows through said exhaust passage, with substantially all of said exhaust gas flowing through said valve in each of said multiple positions, said valve increasing a back-pressure within said exhaust passage by increasingly blocking said exhaust passage with said valve;

wherein said exhaust passage includes a valve body supporting said valve with a shaft extending into said valve body and said valve secured to said shaft, and an electrical actuator rotating said shaft to move said valve between said multiple positions; and wherein said housing includes an actuator mounting pipe extending into a main housing portion and supporting said actuator, and a first bearing arranged on said actuator mounting pipe supports one end of said shaft and a second bearing arranged on said valve body supports another end of said shaft.

8. The powertrain control system according to claim 4, wherein said housing includes a main housing portion having at least one baffle supporting an outer shell, with at least one of said at least one baffle and said valve body including locating features providing a desired orientation between said at least one baffle and said valve body.

9. The powertrain control system according to claim 7, wherein said exhaust passage is in fluid communication with a tuning chamber and said tuning chamber is in fluid communication with an outlet pipe carrying exhaust gas from a main housing portion.

10. The powertrain control system according to claim 1, comprising a position sensor detecting said multiple positions of said valve.

11. The powertrain control system according to claim 1, comprising a return spring biasing said valve to one of said multiple positions.

12. A powertrain control system comprising:

an exhaust muffler including a housing having an exhaust passage;

a valve supported by said housing and arranged in said exhaust passage movable between multiple positions for tuning said exhaust muffler; wherein an exhaust gas flows through said exhaust passage, with substantially all of said exhaust gas flowing through said valve in each of said multiple positions, said valve increasing a back-pressure within said exhaust passage by increasingly blocking said exhaust passage with said valve;

an engine including multiple cylinders producing said exhaust gas;

a controller selectively activating said multiple cylinders to provide a desired power displacement; and an exhaust system including said valve and an electrical actuator selectively electrically actuated by said controller to move said valve between said multiple positions in response to said desired power displacement.

13. The powertrain control system according to claim 12, wherein said exhaust system includes a muffler supporting said valve and said electrical actuator.

14. The powertrain control system according to claim 12, wherein said exhaust system includes a position sensor detecting said multiple positions of said valve, said position sensor communicating to said controller.

15. The powertrain control system according to claim 14, wherein said controller determines a malfunction condition based upon information from said position sensor.

16. The powertrain control system according to claim 12, wherein a return spring biases said valve to one of said multiple positions in a power loss event of said electrical actuator.

17. The powertrain control system according to claim 12, wherein said exhaust system includes at least one valve affanged in at least one exhaust passage, and said exhaust flows through said at least one exhaust passage, with substantially all of said exhaust gas flowing through said valve in each of said multiple positions.

* * * * *